United States Patent [19]

Overholser et al.

[11] Patent Number: 4,510,692

[45] Date of Patent: Apr. 16, 1985

[54] COMBINED BATTERS' AND CATCHER'S BOX MARKING FRAME

[76] Inventors: Duane J. Overholser, 427 NE. Yamhill; Craig M. Prough, 359 NE. Elm, both of Sheridan, Oreg. 97378

[21] Appl. No.: 476,823

[22] Filed: Mar. 18, 1983

[51] Int. Cl.[3] ..... A63C 19/06

[52] U.S. Cl. ..... 33/174 G; 273/25

[58] Field of Search ..... 33/174 G, 174 B, 1 G, 33/1 B, 478, 180 R, 419, 458, 476, 474; 273/25, 1 C, 31

[56] References Cited

U.S. PATENT DOCUMENTS

| | | | |
|---|---|---|---|
| 134,919 | 1/1873 | Moore . | |
| 662,388 | 8/1900 | Bassett . | |
| 838,371 | 4/1906 | Bender . | |
| 937,816 | 10/1909 | Koerner | 33/194 |
| 999,725 | 8/1911 | Adams . | |
| 1,004,471 | 9/1911 | Rose | 33/194 |
| 1,633,996 | 1/1925 | Narrow . | |
| 1,674,882 | 12/1925 | Bloomfield . | |
| 2,733,513 | 2/1956 | Gatineau | 33/174 G |
| 3,889,379 | 6/1975 | Cline . | |
| 3,934,351 | 1/1976 | Sullivan | 33/458 |
| 4,001,063 | 1/1977 | Vaida | 33/419 X |

FOREIGN PATENT DOCUMENTS 960232 3/1957 Fed. Rep. of Germany .

*Primary Examiner*—Harry N. Haroian

*Attorney, Agent, or Firm*—Kolisch, Hartwell and Dickinson

[57] ABSTRACT

A template for marking batters' and catcher's boxes of a ball diamond in conformance with league or other standard regulations. Included is a rectangular frame with dimensions having a preselected relationship to the two types of boxes, an index arm for positioning the frame relative to a home plate for marking a batters' box, and indicia on the frame for locating a catcher's box relative to the previously marked batters' box. Optionally, the frame and index arm dimensions are adjustable, and plural sets of indicia are provided for marking the two types of boxes in conformance with different standard regulations. Additionally, the template may be collapsible for reducing it into a more compact unit.

16 Claims, 10 Drawing Figures

14
12
J
I
H
A
G
C
B
D
10
10a
50
52
56
54
E
F
16

26a
20a
60
18
52
50
58
56
26
26a
24c
64
54
22c
24a
22c
62
30b
32
B
24b
22a
30
24
71
34
30a
22
22b
20
28
28a
68
70
A
66

36
35
44b
42
38
40

44
44a
71
72
5
86
82
76
78
22b
22a
84
74
88
5

72
86
22b
82
78
76
84
88
74

COMBINED BATTERS' AND CATCHER'S BOX MARKING FRAME

BACKGROUND AND SUMMARY OF THE INVENTION

The present invention relates to a marking device usable to mark the batters' and catcher's boxes on a ball diamond. Specifically, it relates to an appropriately dimensioned template having markings for locating and marking the boxes adjacent home plate in one or a plurality of leagues.

Templates conventionally available at ball diamonds are generally sized for marking only the batters' box. The catcher's box is then marked by "eye-balling" the catcher's box area with or without reference to the batters' box template. The resulting disparity in the non-regulation sizes of the catcher's boxes can result in impaired performance by players who cannot establish a consistent visual reference about home plate.

Although the configuration of batters' and catcher's boxes adjacent home plate is similar for all types of ball games played on a diamond-shaped infield, there are variations in the dimensions of the boxes in different leagues. Generally, there is a difference of 12-inches in the width or length of the batters' box, depending upon the controlling league rules. It is common, particularly on "neighborhood" playing fields, that the same playing field is used for little league, major league and softball events, frequently over the course of a single day. Known marking devices do not provide for marking boxes of different sizes.

The most common type of device in use for laying out the boxes adjacent home plate is a wooden or metal frame sized for laying out boxes of a particular league. Generally, plural devices are used to lay out the boxes with each device accommodating only one size of box. The frames, being generally rigid and quite heavy, present storage, handling and damage problems. If the appropriate size template is not available, a "substitute" template of a different size is generally used, with a certain amount of guess work as to the exact size of the box.

A general object of the present invention is to overcome these problems.

More specifically, it is an object to provide a single template usable for marking both a batters' box and an adjacent catcher's box about home plate for a known league.

Another object of the invention is to provide a single box-marking frame which may be used in conformance with regulations of a variety of leagues.

A further object of the invention is to provide a template which may be collapsed for easy storage and transport.

The preferred embodiment of the instant invention is collapsible. Included is a rectangular frame having outer dimensions corresponding to a batters' box and inner dimensions corresponding to a catcher's box. An index arm is mounted on the frame for locating the batters' boxes relative to home plate. Indicia or marks on the frame provide for positioning the frame relative to a previously marked batters' box to mark a catcher's box. The width of the frame material is sized to compensate for the difference in the sizes of the catcher's and batters' boxes.

The sides and ends of the preferred embodiment are also adjustable to conform to the regulations of a plurality of leagues.

The present invention also contemplates a frame being collapsible into a relatively small package for storage and/or transportation.

These and additional objects and advantages of the present invention will be more clearly understood from the following description of the drawings and detailed description of the preferred embodiment.

DETAILED DESCRIPTION OF THE INVENTION

Figures 1, 2, 3, 4, 5:
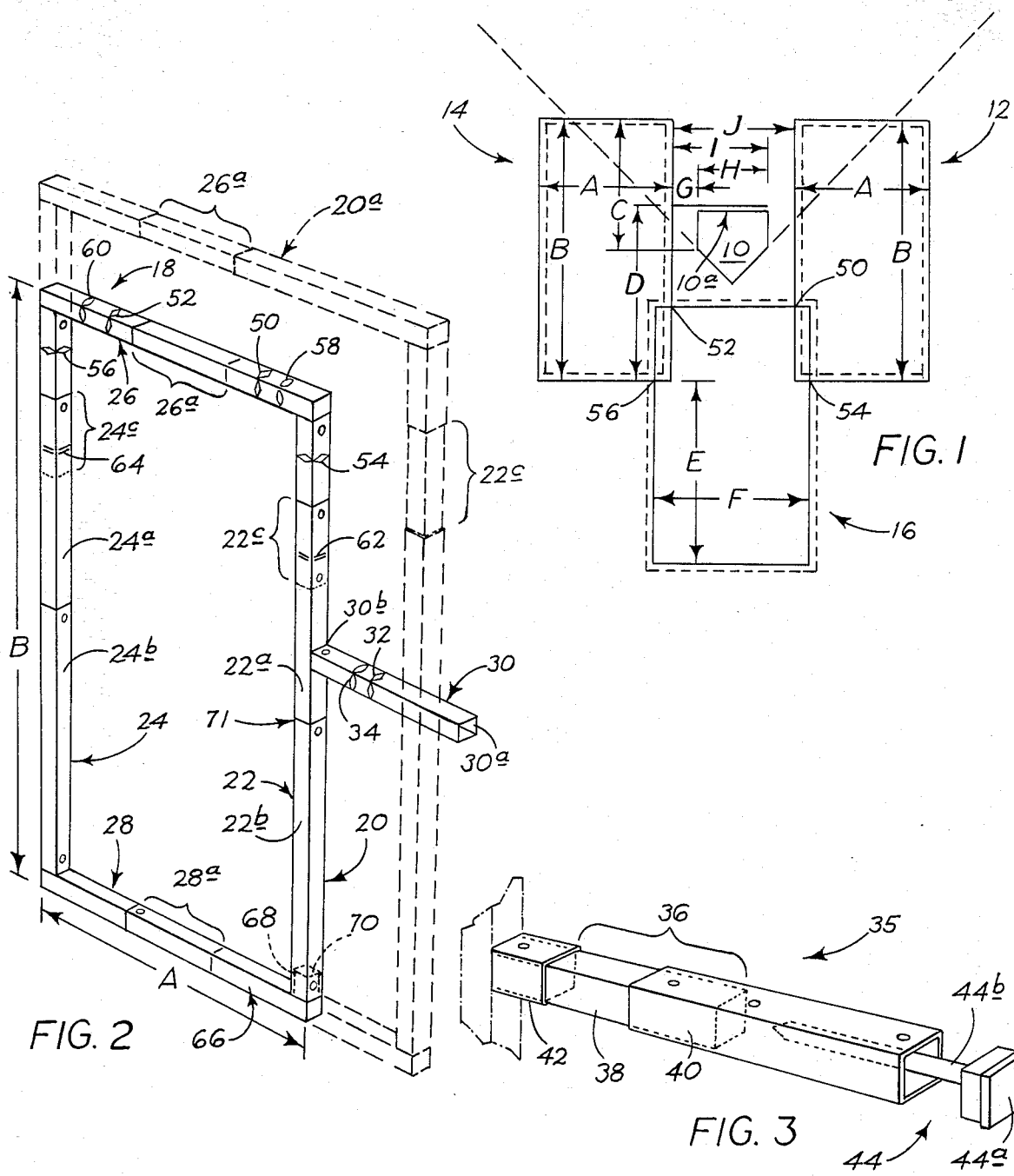
FIG. 1 is a plan view, not to scale, of a typical layout of batters' and catcher's boxes adjacent a home plate of a ball diamond.
FIG. 2 is a perspective view of a first preferred embodiment of a template, shown in two adjusted sizes, made in accordance with the present invention, including a fixed-length index arm.
FIG. 3 is an enlarged, fragmentary perspective view of a telescoping index arm employed with the embodiment of FIG. 2.
FIG. 4 is a further enlarged, fragmentary, partial cross section, side elevation of a portion of the template of FIG. 2.
FIG. 5 is a cross section taken along line 5—5 in FIG. 4.

Turning now to the drawings, and particularly FIG. 1, a portion of a ball diamond adjacent a home plate 10, having an infield edge 10*a*, is shown. Two batters' boxes 12, 14 are layed out with reference to home plate 10. A catcher's box 16 is positioned with reference to boxes 12, 14, as shown.

Boxes 12, 14 and 16 are required, by league regulations, to be of specific dimensions and relative positions. Dimensions are indicated generally in FIG. 1. Batters' boxes 12, 14 each has a width 'A' and length 'B'. Dimension 'C' represents the distance from the forward edge of a batters' box to the center of home plate. The rear, or bottom sides of boxes 12, 14, are a distance 'D' behind the infield edge 10*a*. The rear of catcher's box 16 is a distance 'E' behind the rear edges of boxes 12, 14. Box 16 has a width 'F'. 'G' represents the distance between the nearest side of plate 10 and the side of box 12 or 14. Plate 10 has a width 'H'. 'I' is the sum of distances 'G' and 'H'. 'J' is the distance between batters' boxes. These dimensions for particular leagues are set forth in Table 1.

TABLE 1

| Dimensions | Major League | Little League | Softball |
|---|---|---|---|
| A | 48" | 36" | 36" |
| B | 72" | 72" | 84" |
| C | 36" | 36" | 48" |

TABLE 1-continued

| Dimensions | Major League | Little League | Softball |
|---|---|---|---|
| D | 44½" | 44½" | 44½" |
| E | 60" | *60" | 120" |
| F | 43" | *43" | 101" |
| G | 6" | 4" | 6" |
| H | 17" | 17" | 17" |
| I | 23" | 21" | 23" |
| J | 29" | 24" | 29" |

*No specific dimensions stated; usually marked to major league dimensions. All measurements refer to exterior box dimensions.

The exterior dimensions of a box are scribed on the ground adjacent home plate and then enhanced by chalk marks generally made of some form of powdered lime or other dust-like material. There are no specific dimensions for the chalk lines themselves. The lines will vary typically from 2½ to 4-inches in width, depending on the type of chalk laying apparatus which is used. It is therefore important that precise exterior dimensions be layed out for the boxes, since a player is out of bounds only if his foot extends beyond the chalk line as marked.

Turning now to FIG. 2, a marking template is shown generally at 18. The template includes a rectangular frame 20, having a pair of spaced-apart parallel sides 22, 24, with separable, equal-length side elements 22*a*, 22*b* and 24*a*, 24*b*, respectively, and a pair of spaced-apart parallel ends 26, 28.

Template 18 also includes an index arm 30 having length "I" which acts as a means for positioning the frame in a regulation position relative to home plate 10 for marking batters' boxes 12, 14. Arm 30 is removably mounted on side element 22*a*, normal to the length of side 22 and at a distance 'D' (see Table 1) from the outer margin of end 28 as shown.

When in use, template 18 is positioned on the ground adjacent home plate 10, with index arm 30 placed parallel with and adjacent infield edge 10*a* of the plate, thereby orienting sides 22, 24 of frame 20 in a position normal to edge 10*a*. Arm 30 includes an end 30*a*, also referred to herein as reference means, alignable with an opposite corner of plate edge 10*a* for positioning frame 20 a proper distance 'G' from the near edge of home plate 10. Additionally, a mark 32 exists on arm 30 a distance 'G', equal to 6-inches, from its other end 30*b* adjacent side 22 for alignment with a corner of plate edge 10*a* near frame 20 for marking in accordance with major league standards. Mark 32 is used like end 30*a* for positioning frame 20 relative to plate 10. A second mark 34 is disposed 4-inches from arm end 30*b* for use in marking in accordance with little league standards, as indicated in Table 1. Marks 32, 34 are also referred to herein as reference means.

Additionally, an index arm 35, similar to arm 30, may be modified, as shown in FIG. 3, to include a telescoping portion 36 which allows an adjustment of the length of arm 35 to provide a dimension "G" of different lengths. Included is an inner section 38, which slidably receives an outer section 40 on one of its ends. The other end of section 38 is fixedly mounted on a base section 42 of arm 35. Inner section 38 is held in position relative to outer section 40 by a mortise-tenon type of joint construction described subsequently with reference to FIGS. 4, 5.

Telescoping portions, 22*c*, 24*c*, similar to those discussed with reference to FIG. 3, but of an adjusting length of 12-inches, are incorporated into side elements 22*a*, 24*a*, respectively, to vary dimension 'B'. Telescoping portions 26*a*, 28*a* are incorporated, respectively, into ends 26, 28 to vary dimension 'A'. Frame 20 is thereby capable of expanding, as shown by dashed lines 20*a* in FIG. 2.

Still referring to FIG. 3, a releasably attached scribe 44, or scribe means, may be incorporated into index arm 35 for marking a box on the ground. Scribe 44 has a handle 44*a* which releasably snaps into place in the end of arm 35, using a mortise-tenon type connection similar to the type which will be further detailed with reference to FIGS. 4, 5. Fixedly mounted on handle 44*a* is an elongate rod 44*b* which fits unobstructably inside arm 35 during normal storage. Scribe 44 is removed prior to positioning frame 20, so that the additional length of the scribe will not affect the length of arm 35 and thereby dimension 'I'. Once frame 20 is positioned relative to home plate 10, an outline of a batters' box is marked in the ground with the tip of rod 44*b*.

The outer and inner dimensions of frame 20 have a preselected relationship to those of the batters' boxes and catcher's box. As indicated in Table 1, the width of a major league batters' box is 48-inches, and the width of a major league catcher's box is 43-inches. This 5-inch difference is accommodated by the dimensions of the frame material. The material in the preferred embodiment has a 2½-inch width; therefore, the difference in the width of a mark of a box marked on the outside of the frame from one marked on the inside of the frame is 5-inches. Thus, a batters' box is marked by scribing the ground along the outside margin of frame 20. A catcher's box is marked by scribing the ground along the inside margin of frame 20. Chalk lines are positioned inside of the lines scribed on the ground.

In order to mark a catcher's box relative to batters' boxes, indicia are located on frame 20 for referencing the position of the catcher's box relative the batters' boxes. The indicia take the form of a set of markings provided on each frame. A set of major league markings is shown at 50, 52, 54 and 56. The markings at 50, 52 indicate where frame 20 would be positioned with lateral reference to batters' boxes 12, 14 for marking a major league catcher's box. Marks 54, 56 align with the ends of batters' boxes 12, 14 to provide proper rearward displacement of the catcher's box relative the batters' boxes. These positions are identified in FIG. 1.

Markings 58, 60, respectively, indicate where frame 20 would be positioned laterally relative batters' boxes 12, 14 for marking a little league catcher's box. As indicated in Table 1, there is no standard rearward displacement (dimension 'E') for a little league catcher's box, and the box is generally layed out as it is for major league play, using marks 54, 56. Separate markings are required for little league due to the difference in dimension 'G'.

As noted in Table 1, a little league batters' box is 3-feet wide, while a major league batters' box is 4-feet wide. These dimensions are accommodated by varying the length of ends 26, 28 by means of adjusting telescoping portions 26*a*, 28*a*, as has previously been described with reference to FIGS. 2 and 3. Since a little league catcher's box is generally layed out to major league dimensions, it is necessary to adjust frame 20 from a 3-foot to a 4-foot width after marking the batters' boxes and before marking the catcher's box. The referencing indicia on an adjustable template are so located formed on frame 20 that the boxes are layed out with preferred dimensions once these adjustments are made and the boxes marked as set forth herein.

Marks 62, 64 are located 60-inches from the outer margin of end 28 and provide guidance for marking a 10-foot deep softball catcher's box, by using the template as a straight-edge ruler, marking off two 5-foot lengths rearward of the batters' boxes. The catcher's box on a softball diamond is a rearward extension of the outermost batters' box lines to a point 10-feet to the rear of the rearmost batters' box end line. Although the described template of the instant invention does not expand to these dimensions, it may be used as a guide for the rearward extension of the batters' box lines. Marks 62, 64 are included on frame 20 to facilitate measuring and marking a softball catcher's box.

Another feature of the instant invention is the incorporation of collapsing means into the template. Collapsing is accomplished either by folding the template, or by separating it into parts, as will be discussed hereinafter. The template is collapsible from a full-marking size to a compact, storage and transporting size.

An exemplary mortise-tenon joint, as shown at 66 in FIG. 2, includes a tenon 68 on end 28 which fits into a mortise 70 on side element 22*b*. Likewise, the other end-side joints are similarly formed. Sides 22 and 24 are separable into elements 22*a*, 22*b*, and 24*a*, 24*b*, respectively, and are joined by similar mortise-tenon joints. Index arm 30 is attached to side element 22*a* by a similar joint.

The joints are held in place by a spring-biased locking pin device. An exemplary joint, such as that located at 71 between side elements 22*a*, 22*b*, is shown in FIGS. 4 and 5. Each mortise-tenon joint has a pair of locking pins 72, 74 which are held in place by a spring 76. As shown in FIG. 4, side element 22*a* has an insert element 78 forming a tenon, permanently attached to it. Spring 76 is retained within insert element 78, with locking pins 72 and 74 protruding through insert locking pin holes 82, 84, respectively, exiting opposite sides of element 78. Side element 22*b* is joined with side element 22*a* by sliding element 22*b* over insert 78, which is sized for snug receipt therein, and manually depressing locking pins 72, 74. When elements 22*a* and 22*b* are properly aligned, locking pins 72, 74 will snap through additional holes 86, 88, respectively, appropriately disposed in element 22*b* as shown. Elements 22*a*, 22*b* may, of course, be separated by manually depressing locking pins 72, 74 and pulling elements 22*a* and 22*b* apart. The entire template may thus be broken down into its individual elements, the longest of which is approximately three feet in length.

Figure 6:
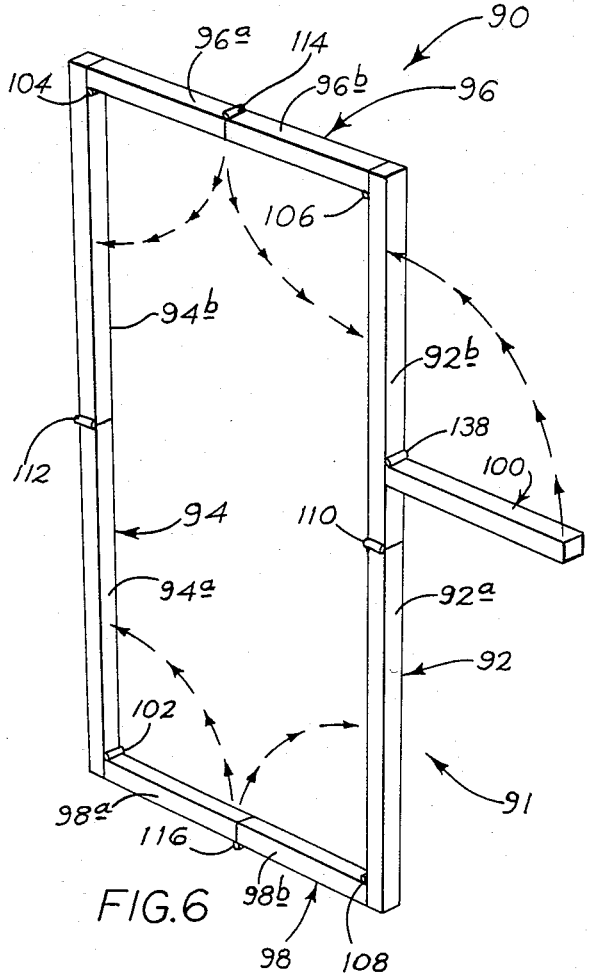
FIG. 6 is a perspective view of a foldable second template embodiment.

Referring now to FIGS. 6 through 10, a modification of the preferred embodiment of the invention utilizing hinge joints as collapsing means is shown generally at 90 in FIG. 6. This embodiment includes a pair of spaced-apart parallel sides 92, 94, and a pair of spaced-apart parallel ends 96, 98, and further includes an index arm 100. This modified embodiment utilizes hinges at corner and midpoint joints to allow the frame to be collapsed upon itself. Corner joints 102, 104, 106 and 108 utilize a 90-degree hinge which folds upon itself. Sides 92, 94 have spring-biased hinge joints 110, 112, respectively. Ends 96, 98 have spring-biased joints 114, 116, respectively.

Figure 9:
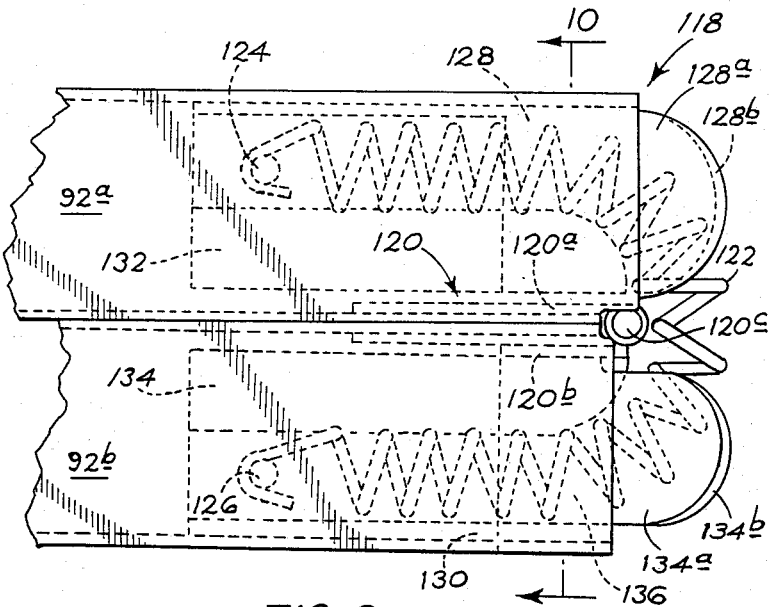
FIG. 9 is an enlarged fragmentary side elevation of a portion of the folded template as shown in FIG. 8.
Figure 10:
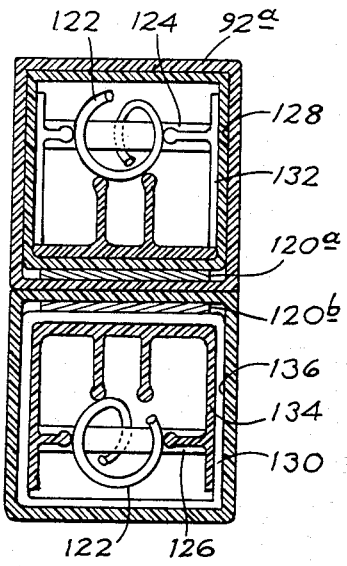
FIG. 10 is an end view of the folded template portion taken along line 10—10 in FIG. 9.

Detail of a spring-biased hinge, such as that at joint 110, are shown in FIGS. 9 and 10. The sides and ends of the template consist of two elements, such as those shown at 92*a*, 92*b*, which are held together by the spring-biased hinge, shown generally at 118 in FIG. 9.

Spring-biased hinge 118 includes a hinge 120, which further includes hinge plates 120*a*, 120*b*, fixedly attached within side segments 92*a*, 92*b*, respectively. The hinge plates are held by a hinge pin 120*c*. A spring 122, held in place by spring pins 124, 126, provides biasing for the joint.

An interlocking flange arrangement is utilized to provide lateral stability to the spring-biased hinge joint. A spacer element 128, 130 is fixedly attached to interior side element 92*a*, 92*b*, respectively. A spring guide 132, 134 is attached interior spacer element 128, 130, respectively. Spacer element 128 includes a flange 128*a* with an arcuate outer beveled edge 128*b*. Spring guide 134 includes a flange 134*a* with a beveled edge 134*b*. Spacer element 130 terminates short of the hinge end of side 92*b*, such that flange 128*a* is receivable in a slot 136 which is formed between side element 92*b* and spring guide 134. Similarly, flange 134*a* is receivable within element 92*a* interior of spring guide 132. When joint 110 is closed with elements 92*a*, 92*b* in longitudinal alignment, the flanges associated with guide 134 are disposed adjacent and interior the corresponding flanges of spacer 128.

Arm 100 is foldably attached to side element 92*b* by spring-biased hinge 138. The actions of the spring-biased joints and the non spring-biased corner joints tend to bias the template to its deployed condition, as shown in FIG. 6.

Figure 7:
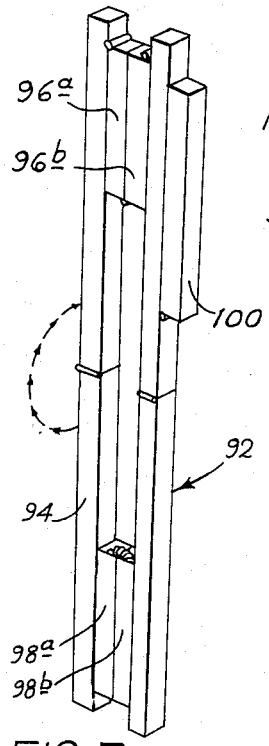
FIG. 7 is a perspective view of the template of FIG. 6 in a partially folded condition.
Figure 8:
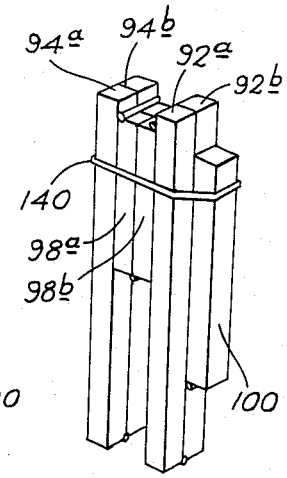
FIG. 8 is a perspective view of the template of FIG. 6 in a completely folded condition.

The deployed template may be folded by first compressing ends 96, 98 and the index arm 100 at hinge points 114, 116 and 138, respectively. The result of this action is shown in FIG. 7. The template is then completely collapsed by folding sides 92, 94 up on themselves at hinge points 110, 112, resulting in the folded template, as shown in FIG. 8. A rubber band or bungie cord 140 is required to restrain the template in this nondeployed configuration. Again, the result is a collapsed template which is approximately three feet long and less than one foot square, a size which makes it easily storable and transportable. Another advantage of the use of hinge joints is that all of the pieces are an integral unit and are not susceptible to being lost.

This embodiment of the template may also include telescoping portions in the ends, sides and index arm, as was discussed with reference to the first form of the invention. Major league indicia, little league indicia, and softball indicia may be positioned on it, as previously described, for use as a "universal" template.

Thus, a new and improved template for marking the batters' and catcher's boxes about a baseball or softball home plate has been presented. While a preferred embodiment and modifications of the invention have been described, it is appreciated that additional variations and modifications may be made without departing from the spirit of the invention.

Such a variation might be a frame having dimensions which do not exactly conform to the regulation dimensions of a batters' or catcher's box, and a scribe with an offset point which compensates for the variance from the standard dimensions during the scribing. Another variation might be a frame that is dimensioned for a particular league and does not include adjustable features or plural sets of markings.

It is claimed and desired to be secured by Letters Patent:

1. A template usable for marking each of two batter's boxes and a catcher's box with reference to a home plate of a ball diamond, where such boxes have predetermined widths and lengths as set by regulations of a particular league and where each side of such catcher's box contacts an end of a batter's box, said template comprising a rectangular frame having a pair of spaced-apart parallel sides and a pair of spaced-apart parallel ends, said frame sides and ends being structured with dimensions having a preselected relationship to those of a batter's box and a catcher's box, means for positioning said frame in a regulation position relative to a home plate for marking a batter's box, and indicia formed on said frame for referencing said frame relative to at least one first-marked batter's box for marking a catcher's box in a regulation position.

2. The template of claim 1 which further includes means for adjusting the dimensions of said frame to conform to the regulation box dimensions of a plurality of leagues.

3. The template of claim 1, wherein the dimensions of one of the two types of boxes are greater than those of the other, and said frame is constructed to have an outer edge which corresponds to the larger of the box dimensions and an inner edge which corresponds to the smaller of the box dimensions.

4. The template of claim 1, which is usable where such a home plate has an edge of a known length disposed normally to a corresponding side of a batter's box, and wherein said means for positioning includes an index arm attached normally to one of said frame sides intermediate its ends, with an edge locatable adjacent the home plate edge, said arm also having reference means associateable with an end of the home plate edge.

5. The template of claim 4, wherein said index arm further includes additional reference means for adjusting the position of said frame relative to the home plate for marking batter's boxes conforming to regulation dimensions of a plurality of leagues.

6. The template of claim 5, wherein said index arm reference means includes means for adjusting the length of said index arm.

7. The template of claim 4, wherein said index arm reference means includes at least one mark disposed on said index arm.

8. The template of claim 4, which further includes scribe means releasably attached to said frame/index arm assembly for marking the ground relative to said frame for locating one of said boxes.

9. The template of claim 1, wherein said catcher's box indicia includes a set of markings disposed on said frame alignable with at least one first-marked batter's box to locate said frame relative such first-marked batter's box for marking a catcher's box.

10. The template of claim 9, wherein said catcher's box indicia further includes other sets of markings, with each set corresponding to dimensions of different catcher's boxes.

11. The template of claim 1, which further includes collapsing means for breaking down said template into a more compact unit.

12. The template of claim 11, wherein said collapsing means includes means for removably joining said frame sides and ends, and positioning means.

13. The template of claim 11, wherein said collapsing means includes hinge means for foldably joining said frame sides and ends, and positioning means.

14. The template of claim 13, wherein said hinge means includes spring-biasing means biased to resist folding.

15. A template usable for marking each of two batters' boxes and a catcher's box with reference to a home plate, having an edge, of a ball diamond, where such boxes have predetermined widths and lengths as set by regulations of a particular league and where each side of such catcher's box contacts an end of a batters' box, said template comprising a rectangular frame having a pair of spaced-apart parallel sides and a pair of spaced-apart parallel ends, said frame sides and ends being structured with dimensions having a preselected relationship to those of a batters' box and a catcher's box, an index arm attached normally to one of said frame sides intermediate its ends, with an edge locatable adjacent the home plate edge, said arm having reference means associateable with an end of the home plate edge for marking a batters' box, catcher's box side indicia disposed on at least one of said frame sides alignable with at least one first-marked batters' box to locate said frame relative such first-marked batters' box for marking a catcher's box.

16. The template of claim 15, which further includes catcher's box end indicia disposed on said frame ends alignable in cooperation with said side indicia with a pair of spaced-apart marked batters' boxes to locate said frame relative to said spaced-apart boxes for marking a catcher's box with symmetrical relationship to the batters' boxes.

* * * * *